US007868552B2

(12) United States Patent
Nishiaki et al.

(10) Patent No.: US 7,868,552 B2
(45) Date of Patent: Jan. 11, 2011

(54) SHORT ARC LAMP

(75) Inventors: Aiko Nishiaki, Hyogo (JP); Shigeru Chiba, Hyogo (JP)

(73) Assignee: Ushio Denki Kabushiki Kaisha, Tokyo (JP)

( * ) Notice: Subject to any disclaimer, the term of this patent is extended or adjusted under 35 U.S.C. 154(b) by 635 days.

(21) Appl. No.: 11/822,605

(22) Filed: Jul. 9, 2007

(65) Prior Publication Data

US 2008/0007177 A1 Jan. 10, 2008

(30) Foreign Application Priority Data

Jul. 7, 2006 (JP) ..... 2006-188376

(51) Int. Cl.
*H01J 17/18* (2006.01)
*H01J 5/16* (2006.01)

(52) U.S. Cl. ..... 313/623; 313/110; 313/318.11

(58) Field of Classification Search ..... 313/110–113, 313/318.11, 634, 636, 284–285, 623, 246
See application file for complete search history.

(56) References Cited

U.S. PATENT DOCUMENTS 5,789,863 A 8/1998 Takahashi et al.
6,768,264 B2 * 7/2004 Beech et al. ..... 313/634
2005/0264150 A1 * 12/2005 Sawada ..... 313/113
2006/0083517 A1 * 4/2006 Saito et al. ..... 398/140

FOREIGN PATENT DOCUMENTS

JP 09-161727 A 6/1997
JP 2005-071684 A 3/2005

* cited by examiner

*Primary Examiner*—Anne M Hines
(74) *Attorney, Agent, or Firm*—Rader, Fishman & Grauer PLLC

(57) ABSTRACT

A short arc lamp comprises a body portion made from an insulating material and having a curved reflective surface, in which a concave discharge space is formed; a pair of cathode and anode disposed at a focal point of the reflective surface with a gap; a support member connected to the cathode; and an electric supply ring connected to the support member, wherein a heat release member is provided on the anode or the support member or when a heat capacity of the cathode is A and that of the support member is B, a relationship of A and B is B/A>2.8.

20 Claims, 6 Drawing Sheets

SHORT ARC LAMP

CROSS-REFERENCE TO RELATED APPLICATIONS

This application claims priority from Japanese Patent Application Serial No. 2006-188376 filed on Jul. 7, 2006, the contents of which are incorporated herein by reference in its entirety.

TECHNICAL FIELD

Described herein is a short arc lamp, and especially a short arc lamp used for illumination carried out through an optical fiber after condensing light from a powerful point light source, in a minute area, like a light source of an endoscope.

BACKGROUND

Although transparent ceramics, quartz glass or other glass material is used for an arc tube of such a short arc lamp in general, a lamp for a special use in which a lamp main body is made from opaque ceramics, and translucent ceramics is used for only the optical extraction section, is known. This lamp has a pillar-shaped appearance as a whole, and is very strong and can be easily dealt, and such a lamp is used as a lamp for medical treatments because it is highly safe.

Such a conventional short arc lamp is explained referring to FIGS. 10A and 10B. FIG. 10A is a cross sectional view of the conventional short arc lamp, and FIG. 10B is a diagram in which only an electric supply ring 203, a support member 210, and a cathode 204 of the short arc lamp shown in FIG. 10A are shown.

The body portion 201 of the short arc lamp 200 is made from an insulating member made of alumina, and a concave electrical discharge space D which is partially defined by a reflective surface 202 is formed therein. In the concave electrical discharge space D, the tungsten cathode 204 and a tungsten anode 205 in which thorium oxide is doped, are arranged at a focal point of the reflective surface 202 with a gap therebetween. A tip edge of the body portion 201, leads out of an opening of a reflective surface 202, in which an electric supply ring 206 made of kovar which has an outer diameter approximately equal to the outer diameter of the body portion 201 is arranged through a ceramic ring 203 thereto. A ring-like flange 207 is inserted in the inside of the electric supply ring 206 so as to be in contact with the inside of the ring 206, and a transparent window member 208 which is made of sapphire is joined to the inner circumference face of the flange 207. A first metal member 209 is provided, so that the electric supply ring 206, the flange 207 which is arranged in contact with the inner circumference face of the ring 206, and the window member 208 are fixed to the body portion 201. In a radius direction of the electric supply ring 206, in the concave electrical discharge space D, molybdenum support members 210 whose current transport property and thermal resistance are considered, extends, one end of which is connected to the electric supply ring 206, and the other end of which is connected to the cathode 204. That is, while the support member 210 forms a path for passing current to the cathode 204, it supports the cathode 204 so as to be arranged at a predetermined position of the concave electrical discharge space D.

Recently, when using such a short arc lamp as a light source of an endoscope, there is a demand that the optical output be increased so as to reproduce an affected part more clearly. As a method of increasing an optical output, the brightness of an arc is raised by shortening a distance between electrodes, or increasing an input current.

In the short arc lamp in which such a measure is taken, there is a tendency that the temperature of an electrode rises, and specifically, the problems set forth below may occur in connection with the temperature rise of the cathode.

As shown in FIG. 10B, the cathode 204 is joined to the end portion side of the support member 210 by brazing which uses wax material. The technology in which the support member is joined with the cathode by the wax material is disclosed in Japanese Laid Open Patent No. H09-161727. Or, although not illustrated, in a state where the cathode 204 and the support member 210 are in contact with each other, a contact portion thereof is heated by laser etc. so that the cathode 204 and the support member 210 are welded and joined to each other. Similarly, the technology in which the support member and the cathode are joined by welding is disclosed in Japanese Laid Open Patent No. H09-161727. In such a structure, the heat of the cathode 204 is transmitted to the support member 210, the heat of the support member 210 is transmitted to the electric supply ring 206, and, finally the heat of cathode 204 is radiated from a first metal member 209.

However, if the temperature of the cathode 204 rises, the heat dissipation effect of the heat dissipation path reaches to the limit, and the heat of the cathode 204 cannot be fully released, so that the temperature of wax material at a coupling area of the cathode 204 and the support member 210 or the temperature of a welding portion rises. This is attributed to the temperature rise of the cathode 204 itself and the temperature rise of the support member 210 due to a heat accumulation therein because the heat which is conducted in the support member 210 is not fully conducted to the electric supply ring 206.

And where stress is repeatedly generated in the wax material or the welding portion, with turning on and off a lamp, so that the temperature of the wax material or the welding portion rises excessively, the cracks are generated in the wax material or the welding portion at an early stage, and if stress is repeatedly generated in the state where these cracks are generated therein, these cracks grow whereby the wax material or the welding portion is destroyed. And when such a destructive state advances, there is a problem that the cathode 204 drops out of the support member 210. Moreover, when the temperature of the wax material becomes 1000 degrees Celsius or more, the wax material melts. When this phenomenon happens, there is a problem that the cathode 204 drops out of the support member 210.

On the other hand, the technology is known in which, not in order to control the temperature rise of the coupling area of the cathode and the support member but in order to control the temperature rise of a joint of the support member and the electric supply ring, the support member is bent or crooked so as to increase the surface area of the support member, thereby positively releasing heat from the supporting member. This technology is disclosed in Japanese Laid Open Patent No. 2005-71684.

However, there are problems that when the support member is bent or curved, it became difficult to position the cathode in a predetermined position, and if the temperature of the support member rises during lighting, the support member is expanded so that the position of the cathode shifts from the predetermined position.

SUMMARY

In embodiments described below, in order to solve such a problem, the temperature rise of a cathode and a coupling area(s) of the support member(s) which supports the cathode can be suppressed, even though the output of the light emitted from a short arc lamp becomes large. Therefore, a short arc lamp in which part of the coupling area of the cathode and the support member(s) is not destroyed, and the cathode does not drop out of the support member(s) and further, the cathode can certainly be supported by the support member(s) at a predetermined position of an electrical discharge space, is offered.

Accordingly, a short arc lamp comprises a body portion made of an insulating material and having a curved reflective surface, in which a concave discharge space is formed; a pair of cathode and anode disposed at a focal point of the reflective surface with a gap; a support member(s) connected to the cathode; an electric supply ring connected to the support member(s), wherein when a heat capacity of the cathode is A and that of the support member(s) is B, a relationship of A and B is B/A>2.8.

The heat release member may be connected to the cathode or the support member(s).

The cathode may be made of tungsten, and the support member(s) may be made of nickel.

According to the short arc lamp, when the heat capacity of the cathode is A and the heat capacity of the support member (s) is B, under a condition where B/A>2.8, the heat of the cathode is efficiently transmitted to the support member(s), and the heat can be efficiently released to the electrical discharge space from the support member(s), and the temperature rise of the coupling area of the cathode and the support member(s) can be suppressed. Consequently, even if an output of the light emitted from the short arc lamp becomes large, the temperature rise of the coupling area of the cathode and the support member(s) can be controlled, and part of the coupling area of the cathode and the support member(s) is not destroyed, and the cathode does not drop out of the support member(s), and further the cathode can be certainly supported by the support member(s) at a predetermined position of the electrical discharge space.

BRIEF DESCRIPTION OF THE DRAWINGS

Other features and advantages of the present short arc lamp will be apparent from the ensuing description, taken in conjunction with the accompanying drawings, in which.

DETAILED DESCRIPTION

Figure 1:
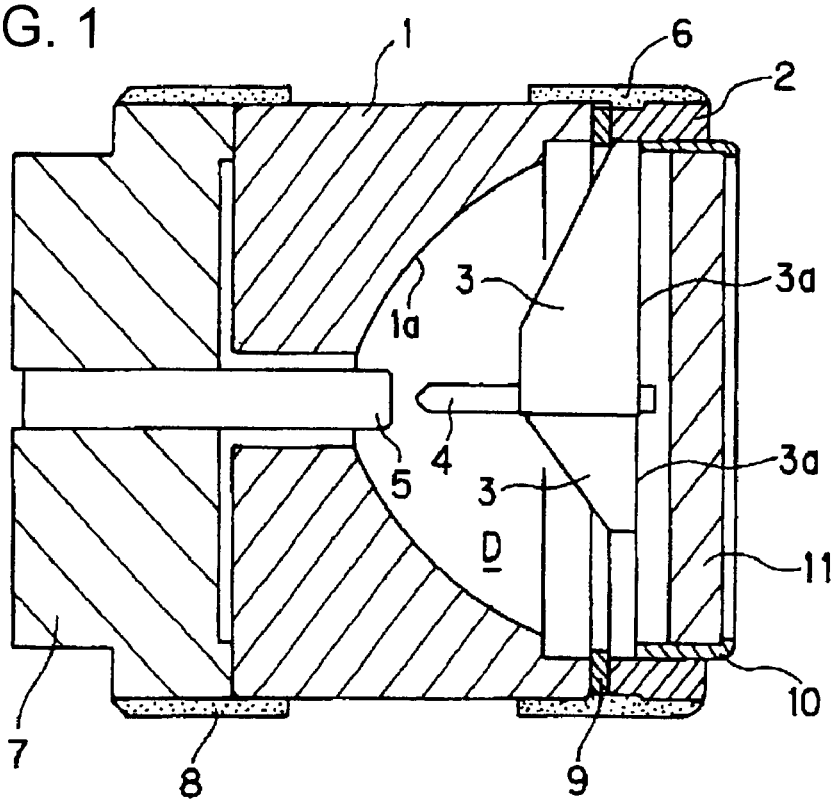
FIG. 1 is an explanatory diagram of a short arc lamp according to an embodiment the present invention.

Description of a short arc lamp according to the embodiment will be given below. FIG. 1 is a diagram showing the structure of an example of the short arc lamp according to the embodiment. The body portion 1 is made of an alumina insulating member, and an outer diameter thereof is about 30 mm. In the interior of the body portion 1, a reflective surface 1*a* is formed. The reflective surface 1*a* can be a parabolic shape, an ellipse shape, or an aspheric shape, so as to obtain an optical output with high directional characteristics. In this embodiment, the reflective surface 1*a* of this short arc lamp has a paraboloidal surface. And in order to increase the reflective efficiency thereof, metal, such as silver and aluminum, is deposited. A dielectric multilayer may be provided thereon, instead of the metal vapor-deposited film. Inside the reflective surface 1*a*, an electrical discharge space D is formed, and a cathode 4 and an anode 5 face each other with a gap at a focal point of the reflective surface 1*a*, so as to be in agreement with the axis of the reflective surface 1*a*. The cathode 4 and the anode 5 are made of tungsten, and the gap of the cathode 4 and the anode 5 is 1-2 mm. A taper portion having an angle of about 30 to 50 degrees is formed, at the tip of the cathode 4. The taper angle is provided, in order to obtain good electron emission. In addition, the cathode 4 may be made of thoriated tungsten in which thorium oxide is doped.

The tip edge of the body portion 1 following (defining) an opening of the reflective surface 1*a*, is in contact with one side of a ceramic ring 9 having an outer diameter almost equal to the outer diameter of the body portion 1. And an electric supply ring 2 made of kovar with an outer diameter almost equal to the outer diameter of the body portion 1 is arranged near the opening edge of the reflective surface 1*a*, specifically, on the other side surface of the ceramic ring 9. The ring-like flange 10 is inserted so as to be in contact with the inner face of the electric supply ring 2. The flange 10 has a transparent circular window member 11 in the inner circumference face thereof. This window member 11 transmits a visible light, and made of sapphire because the coefficient of thermal expansion of the sapphire is close to that of kovar of the electric supply ring 2.

A first metal member 6 is made of kovar, and fixes the electric supply ring 2, the flange 10 arranged so as to be in contact with the inner circumference face of the electric supply ring 2, and a window member 11, to the body portion 1. The width of the first metal member 6 is about 10 mm and the thickness thereof is about 1 mm. That is, the sealing state of the internal electrical discharge space D is maintained by the first metal member 6, the electric supply ring 2, the flange 10, and the window member 11. The first metal member 6 serves also as an electric supply means for supplying current to the cathode 4 through the electric supply ring 2 and the conductive support members 3. In this embodiment, three support member are disposed.

Each of the support members 3 is made of molybdenum which is selected in consideration of current transport property and thermal resistance. In the electrical discharge space D, each support member extends in a radius direction of the electric supply ring 2, one end of which is connected to the electric supply ring 2, and the other end of which is connected to the cathode 4 by brazing. That is, the support members 3 are not only paths for passing current to the cathode 4, but they support the cathode 4 so as to be arranged in a predetermined position of the electrical discharge space D. Each of the support members 3 is arranged so that a direction of a short length of the support member 3 may be parallel to the lamp axis, so as not to interrupt reflected light from the reflective surface 1*a*. In addition, without using a wax material, the cathode 4 may be welded directly to the support members 3 so as to be connected.

The outer diameter of part of a metal block 7 is almost the same as that of the body portion 1, and the metal block 7 is fixed to the body portion 1 by a second metal member 8. The anode 5 penetrates through the metal block 7 at the center thereof, and the metal block 7 is electrically connected to the anode 5. That is, the second metal member 8 serves also as a electric supply means for supplying current to the anode 5 through the metal block 7. Furthermore, the width of the second metal member 8 is about 8 mm and the thickness thereof is about 1 mm. The metal block 7 also serves as a heat absorber of the body portion 1, so as to prevent the inside of the electrical discharge space D from excessively rising in temperature. Thus, the metal block 7 is made of metal since it is rich in conductivity, and a heat absorptive action can be expected.

The short arc lamp is formed as mentioned above, and inert gas, such as xenon, is filled up in the electrical discharge space D of the short arc lamp at pressure of tens of atmospheres, and further rated current of the short arc lamp is 20 A and the power consumption thereof is 280 W.

Figure 2:
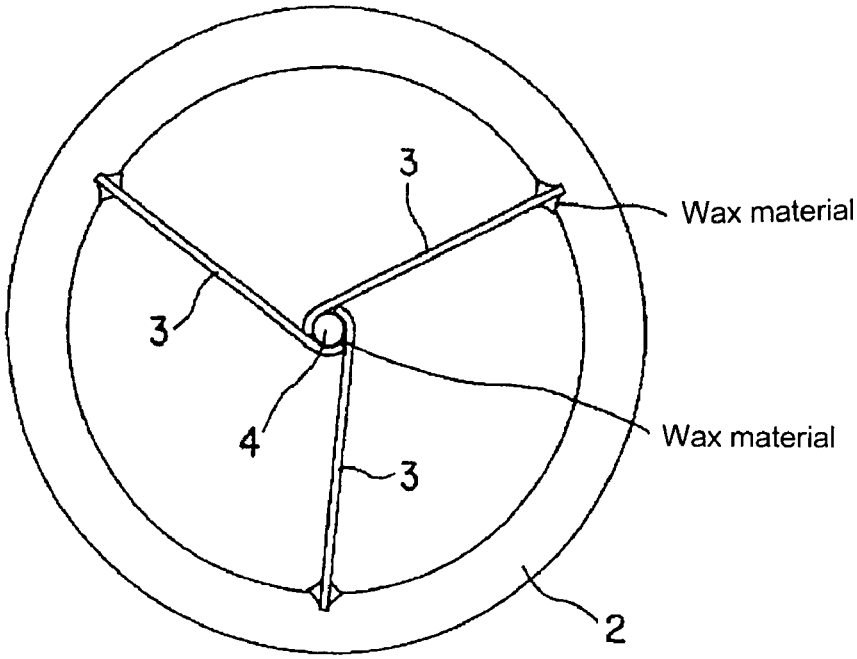
FIG. 2 is an explanatory diagram wherein only an electric supply ring, the support member, and a cathode of a short arc lamp in FIG. 2 are shown.

FIG. 2 is a diagram showing only the electric supply ring 2, the support member 3, and the cathode 4 of the short arc lamp shown in FIG. 1. The cathode 4 is supported at the predetermined position of the electrical discharge space D by the three support members 3. These support members 3 are connected to both of the electric supply ring 2 and the cathode 4 with wax material, respectively. In FIG. 1, each of these support members 3 is made of molybdenum, and has the structure of a shortest side 3*a* which is the shortest distance when the cathode 4 is connected to the electric supply ring 2.

Next, details of the heat capacity of the cathode and the heat capacity of the support member in the short arc lamp according to the embodiment, are explained.

In the short arc lamp shown in FIGS. 1 and 2, the cathode 4 and the support member 3 are connected by the wax material. And each of the support members 3 has a shortest side 3*a* which is the shortest distance when an electric supply ring 2 is connected to the cathode 4. In addition, without using a wax material, the cathode 4 and the support member 3 may be connected by welding.

The cathode 4 is made of tungsten, has the diameter of 1.5 mm and the length of 15 mm, and further, is tapered by gradually cutting it out by 1 mm from the tip thereof. The heat capacity of the whole cathode is $15.03\times10^{-3}$ cal/K.

Figure 3:
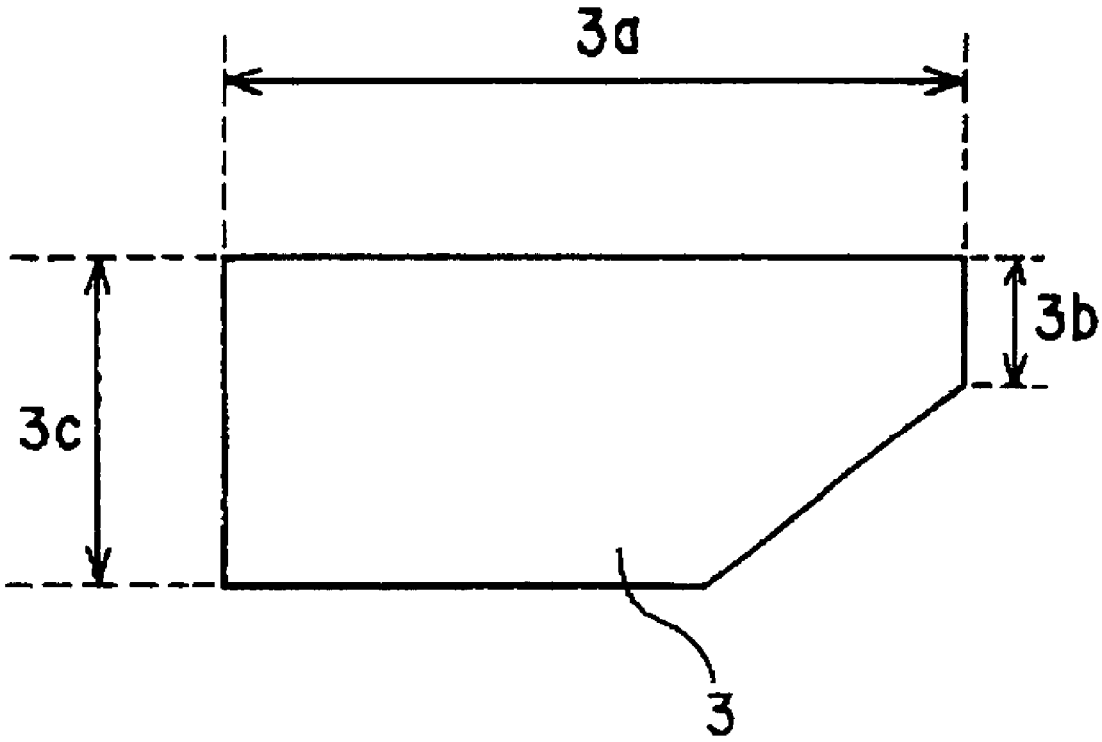
FIG. 3 is an explanatory diagram showing the shape of a support member.

FIG. 3 is an explanatory diagram of the support member 3, in which the support member 3 is made of molybdenum, the length of the shortest side 3*a* is 13 mm, the length of a connection side 3*b* which is connected with the electric supply ring is 2 mm, the length of connection side 3*c* which is connected with the cathode is 5 mm, the thickness thereof is 1 mm, and the heat capacity of each one of the support members 3 is 16.6 cal/K. And the total number of the support members 3 is three, in which all of them has the same shape, and the sum total heat capacities of these three support members 3 is about 50 cal/K.

Next, an experiment was carried out in which the short arc lamp had the same structure as that shown in FIG. 1, and when the heat capacity of the support member was changed by changing the shape of the support member, the connection state of the cathode and the support member was examined after 500 hour lighting. At the lighting state, lighting was not continued for 500 hours, but a cycle of 10 minute lighting and 5 minute light-off was repeated for 500 hours. In addition, in this experiment, the length of shortest side 3*a* of the support members, the length of connection side 3*b* which was connected with the electric supply ring, and the thickness thereof were fixed to 13 mm, 2 mm, and 1 mm, respectively (unchanged), but the length of connection side 3*c* which was connected with the cathode, and the heat capacity of the support member were changed. In addition, the heat capacity of the support members is the sum total of the heat capacity of all the three support members connected to the cathode 4. Moreover, the heat capacity of the cathode 4 is $15.03\times10^{-3}$ cal/K. An experimental result is shown in Table 1.

TABLE 1

| | Material of the support member | The length of a connection side of the support member (mm) | The heat capacity B of the support member (cal/k) | The heat capacity B of the cathode (cal/k) | B/A | The state of connection |
|---|---|---|---|---|---|---|
| Lamp 1 | molybdenum | 4.6 | $40.98*10^{-3}$ | $15.03*10^{-3}$ | 2.726 | the wax material was destroyed and the cathode was shifted |
| Lamp 2 | molybdenum | 4.7 | $41.93*10^{-3}$ | 15.03*10 | 2.790 | Cracks are generated in the wax material |
| Lamp 3 | molybdenum | 4.8 | $42.89*10^{-3}$ | 15.03*10 | 2.854 | No change in wax material |
| Lamp | molybdenum | 4.9 | $43.84*10^{-3}$ | 15.03*10 | 2.917 | No change |

TABLE 1-continued

| | Material of the support member | The length of a connection side of the support member (mm) | The heat capacity B of the support member (cal/k) | The heat capacity B of the cathode (cal/k) | B/A | The state of connection |
|---|---|---|---|---|---|---|
| 4 | | | | | | in the wax material |
| Lamp 5 | molybdenum | 5.0 | $50.00*10^{-3}$ | 15.03*10 | 2.980 | No change in the wax material |
| Lamp 6 | nickel | 4.6 | $62.57*10^{-3}$ | 15.03*10 | 4.160 | No change in the wax material |

As shown in the table 1, when the heat capacity of the cathode was A, and the heat capacity of the support members was B, in the lamp 3, lamp 4, lamp 5, and lamp 6 in which the relationship of A and B was B/A>2.8, even if 500 hours passes after lighting, there was no change in the wax material for a coupling area of the cathode and the support member, and the cathode was certainly supported by the support members.

On the other hand, where the heat capacity of the cathode was A, and the heat capacity of the support members was B, when the relationship of A and B was B/A≦2.8, that is, in the lamp 1, the wax material for a coupling area of the cathode and the support member broke, and the position of the cathode shifted within 500 hours after lighting, or in the lamp 2, the cracks were generated in the wax material.

That is, when a ratio of the heat capacity of the support member to the heat capacity of the cathode exceeded 2.8, the difference of the value of the heat capacity of the cathode and that of the support members was large, and the rate at which the heat generated in the cathode was transmitted to the support members was large, so that the heat of the cathode could be effectively transmitted to the support members. Furthermore, since the heat transmitted to the support members was emitted to the electrical discharge space D, the temperature rise of the wax material which was provided between the cathode and the support members could be controlled.

Consequently, the wax material did not melt, and cracks did not occur in the wax material, and further, the wax material was not destroyed, so that the cathode could always be positioned in a predetermined position of the electrical discharge space.

Moreover, the heat capacity of the support members could be increased even in case of the support members having the same shape, by changing material of the support members from molybdenum to nickel, as shown in the lamp 6 in Table 1. Although the shape of the support member of the lamp 1 was the same as that of the lamp 6 in Table 1, in the lamp which used the support members made of nickel, the heat capacity of the support member could be increased more, and the effect of controlling the temperature rise of the wax material was improved more.

In addition, although in this experiment, for connection of the cathode and the support members, the wax material was used, even when the cathode and the support members were connected directly by welding without using a wax material, there were almost no difference from the experimental results shown in Table 1. When the heat capacity of the cathode was A and that of the support members was B, under the condition where the relationship of A and B was B/A>2.8, even if 500 hours passes after lighting, no cracks were generated in the welding portion of the cathode and the support members, so that the cathode was certainly supported by the support member.

Figure 4:
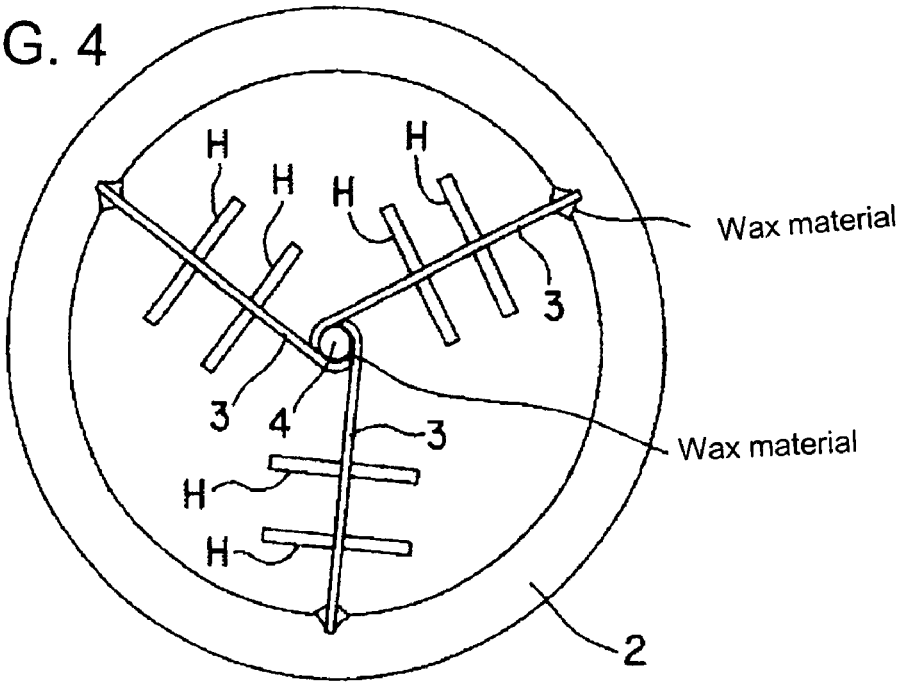
FIG. 4 shows a short arc lamp of another embodiment, wherein only an electric supply ring, a support member, a cathode, and a heat release member are shown.
Figure 5:
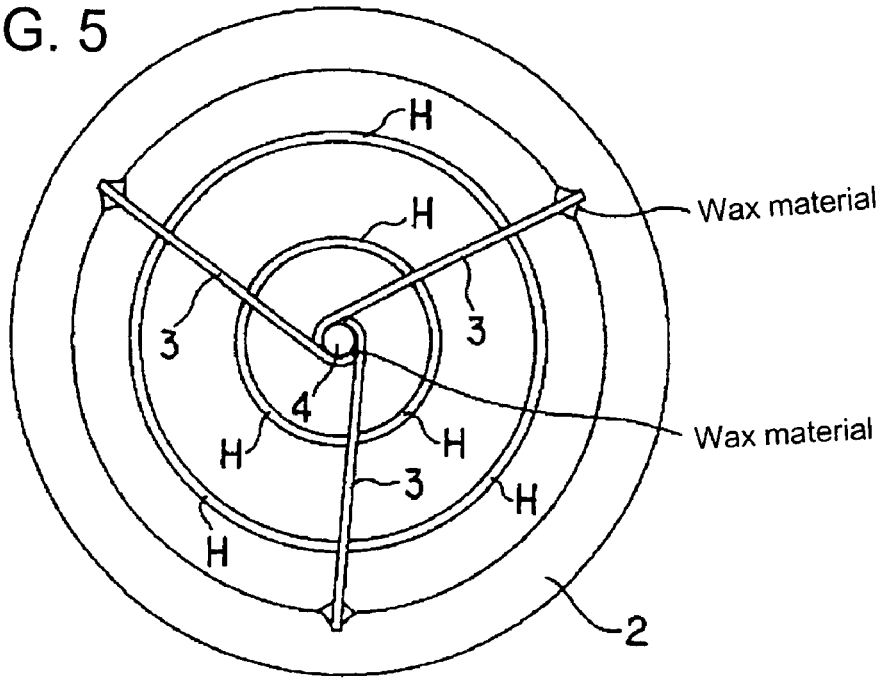
FIG. 5 shows a short arc lamp of still another embodiment, wherein only an electric supply ring, a support member, a cathode, and a heat release member are shown.

Next, an embodiment in which heat release member(s) is connected to support members will be described. FIGS. 4 and 5 are diagrams showing only an electric supply ring 2, support members 3, a cathode 4, and heat release members H (Description of heat release members will be described below). In addition, each of the support members 3 shown in FIGS. 4 and 5 has the shortest side which is the shortest distance when the electric supply ring is connected to the cathode as in FIG. 1. In FIG. 4, two or more heat release members H are added to each support member 3. That is, the heat release members H which are separate components from the support member 3 are connected to the support member 3. Each of the heat release members H is a plate-like member made of molybdenum, one end portion of which is connected to the support member 3 by brazing or welding, thereby increasing the surface area of the support member 3 substantially.

Thus, the heat transmitted from the cathode 4 to the support members 3 can be efficiently released to the electrical discharge space D by the heat release members H which are connected to the support members 3. The temperature rise of the cathode 4 and the support members 3 can be suppressed simultaneously. The temperature rise of the wax material for a coupling area of the cathode 4 and the support member 3 can be suppressed. Even if stress is repeatedly generated in the wax material with turning on and off the lamp, cracks are not generated in the wax material, so that the wax material is not destroyed, and the cathode 4 is certainly supported by the support members 3, and thereby the cathode 4 can be connected at a predetermined position of the electrical discharge space.

In FIG. 5, two or more circular heat release members H are connected to support members 3 so as to connect between these support members 3. Each of the heat release members H is a plate-like member made of molybdenum, both ends of which are connected to the support members by brazing or welding, so as to enlarge the surface area of the support members 3 substantially. Thus, the heat transmitted from the cathode 4 to the support members 3 can be efficiently released to the electrical discharge space D by the heat release members H which are connected to the support members 3. The temperature rise of the cathode 4 can be suppressed and at the same time, the temperature rise of a support member 3 can be suppressed. The temperature rise of the wax material for a coupling area of the cathode 4 and the support member 3 can be suppressed. Even if stress is repeatedly generated in the wax material with turning on and off a lamp, cracks are not generated in the wax material, so that the wax material is not destroyed, and the cathode 4 is certainly supported by the support member 3, thereby always positioning the cathode 4 at a predetermined position of the electrical discharge space.

In the short arc lamp of the structure where the heat release members H are connected to the support members 3 shown in FIGS. 4 and 5, the heat capacity of the support members means the sum total of the heat capacity of the support members 3 and the heat capacity of the heat release members H. Even in case of the structure where the heat release members H are connected to the support members 3, when the ratio of the sum total of the heat capacity of the support members 3 and the heat release member H to the heat capacity of the cathode 4 exceeds 2.8, the rate at which the heat generated in the cathode is transmitted to the support members is large. Thus, since the heat release members H are connected to the support members, the temperature rise at a coupling area between the cathode and the support member can be certainly suppressed.

Next, details of the short arc lamp according to the embodiment, in which the heat capacity of the cathode and the heat capacity of the support member is specified, are explained.

Figure 6:
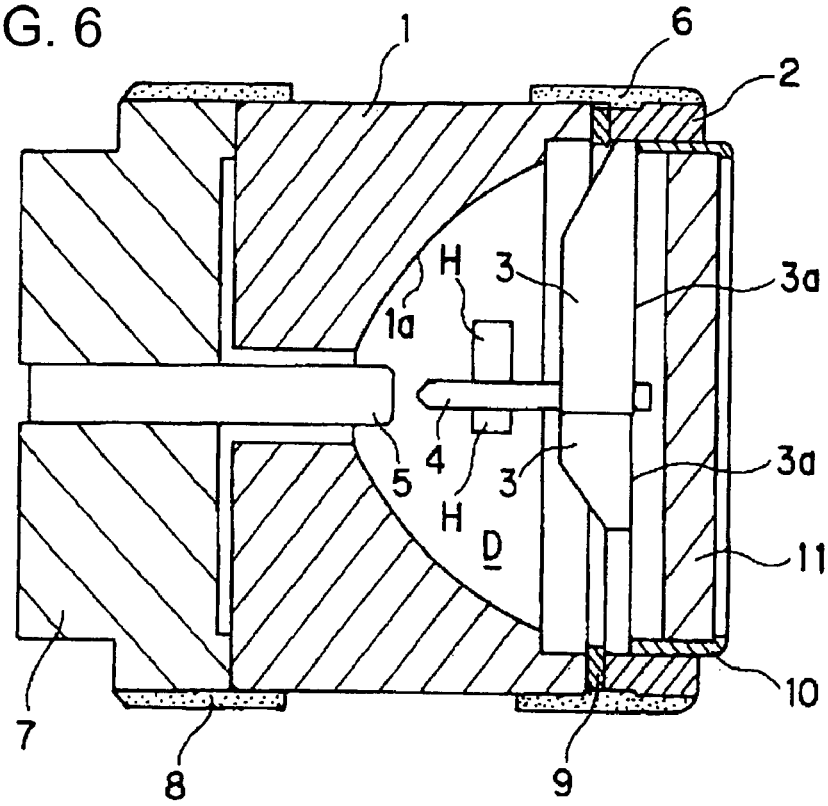
FIG. 6 is a diagram showing a short arc lamp according to an embodiment.
Figure 7:
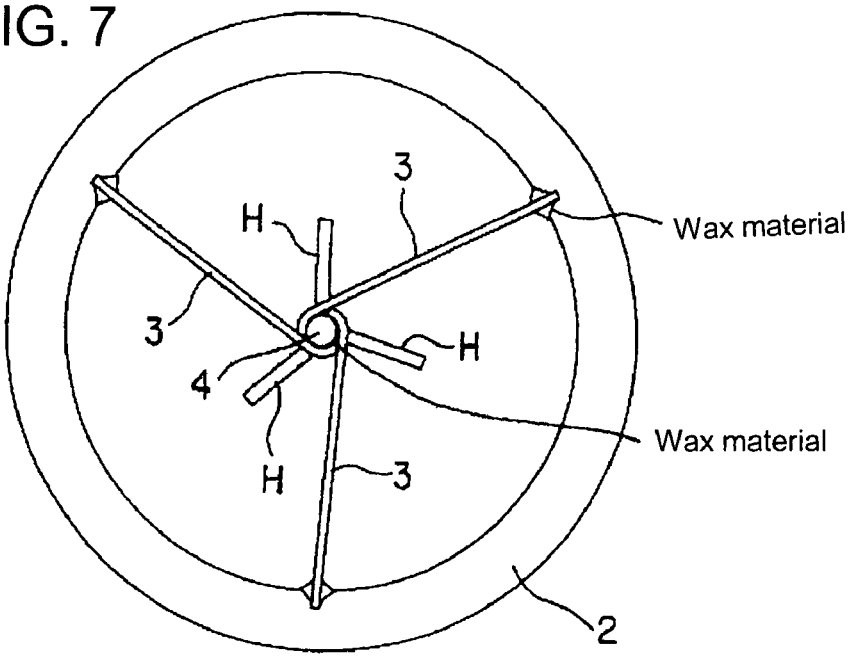
FIG. 7 is a diagram showing only an electric supply ring, a support member, a cathode, and a heat release member of a short arc lamp shown in FIG. 6.

FIGS. 6 and 7 are a diagram of the short arc lamp according to the present invention, in which the heat release members are added to a cathode 4 of the short arc lamp shown in FIG. 1, and the size of the support member becomes small. The same numerals are assigned to the same structural elements of FIG. 1, and only characteristic structural elements will be explained. As in the short arc lamp shown in FIG. 1, in the short arc lamp shown in FIG. 6, inert gas, such as xenon, is filled up in the electrical discharge space D at pressure of tens of atmospheres, and rated current of the short arc lamp is 20 A and the power consumption thereof is 280 W.

Moreover, FIG. 7 is a diagram showing only an electric supply ring 2, a support member 3, a cathode 4, and heat release members H of the short arc lamp shown in an FIG. 6. In addition, as shown in FIG. 7, the cathode 4 is supported by three support members 3.

In the short arc lamp shown in FIGS. 6 and 7, the cathode 4 and the support member 3 are connected by the wax material. And each of the support members 3 has a shortest side 3*a* which is the shortest distance when an electric supply ring 2 is connected to the cathode 4. In addition, without using a wax material, the cathode 4 and the support member 3 may be connected by welding.

The cathode 4 is made of tungsten, has the diameter of 1.5 mm and the length of 15 mm, and further is tapered by partially cutting it out by 1 mm from the tip thereof. The heat capacity of the whole cathode is $15.03\times10^{-3}$ cal/K.

Next, description of the heat release members will be given below. As shown in FIGS. 6 and 7, each of the heat release members H is a plate-like member made of molybdenum, one end portion of which is connected to the cathode 4 by brazing or welding, the other end portion of which is a free end in the electrical discharge space D. Three of the heat release members are attached to the cathode 4 at equal intervals. Such heat release members H are arranged so that the reflected light from reflective surface 1*a* may not be interrupted and the direction of a short length of the heat release members may become parallel to the lamp axis.

Since the heat release members H are made of molybdenum, the thermal conductivity is good, and the heat generated in the cathode 4 is efficiently conducted to the heat release members H. And since the heat release members H are exposed to the electrical discharge space D, the heat of the cathode 4 is released to the electrical discharge space D through the heat release members H, so that the temperature rise of the wax material for a coupling area of the cathode 4 and the support member 3 can be suppressed.

Moreover, even if stress is repeatedly generated in the wax material with turning on and off a lamp, cracks are not generated in the wax material, so that the wax material is not destroyed, whereby the cathode 4 is certainly supported by the support members 3, and it is possible to position the cathode 4 at a predetermined position of the electrical discharge space D. Moreover, by attaching two or more of the heat release members H to the cathode 4, the heat dissipation efficiency of the cathode 4 is increased, so that the temperature rise of the wax material can be suppressed certainly.

In the short arc lamp of the structure where the heat release members H are connected to the cathode 4 shown in FIGS. 6 and 7, the heat capacity of the cathode 4 means the sum total of the heat capacity of the cathode 4 and the heat capacity of the heat release members H. In such a case, when the ratio of the sum total of the heat capacity of the support members 3 to the heat capacity of the cathode 4 exceeds 2.8, the rate at which the heat generated in the cathode is transmitted to the support member is large, so that the temperature rise at the coupling area between the cathode and the support member can be certainly suppressed.

Figure 8:
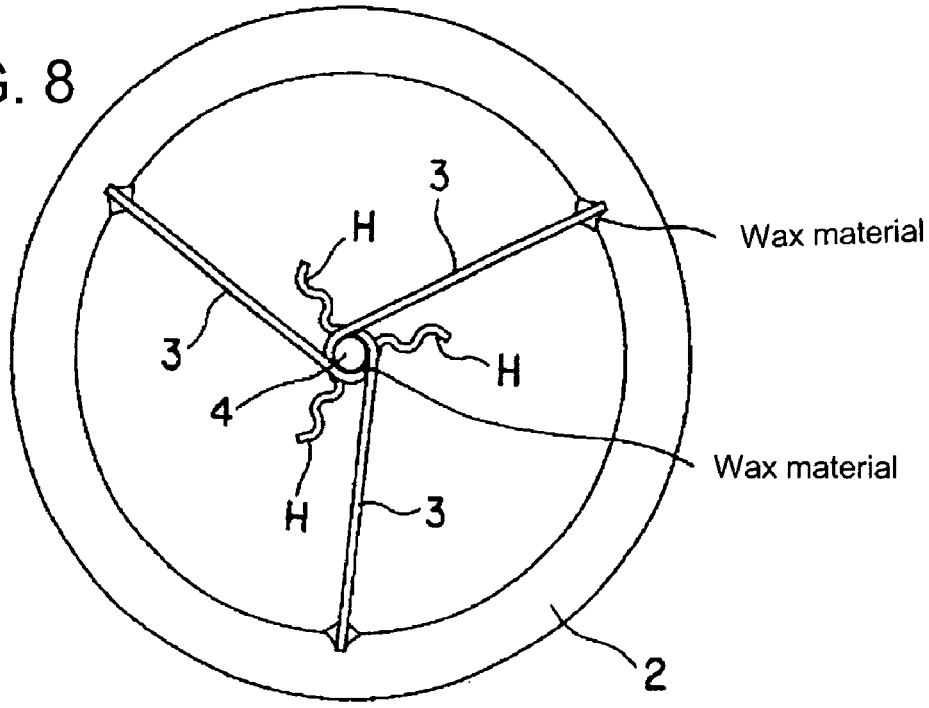
FIG. 8 shows a short arc lamp according to another embodiment wherein only a cathode, a heat release member connected to the cathode, an electric supply ring, and a support member are shown.
Figure 9:
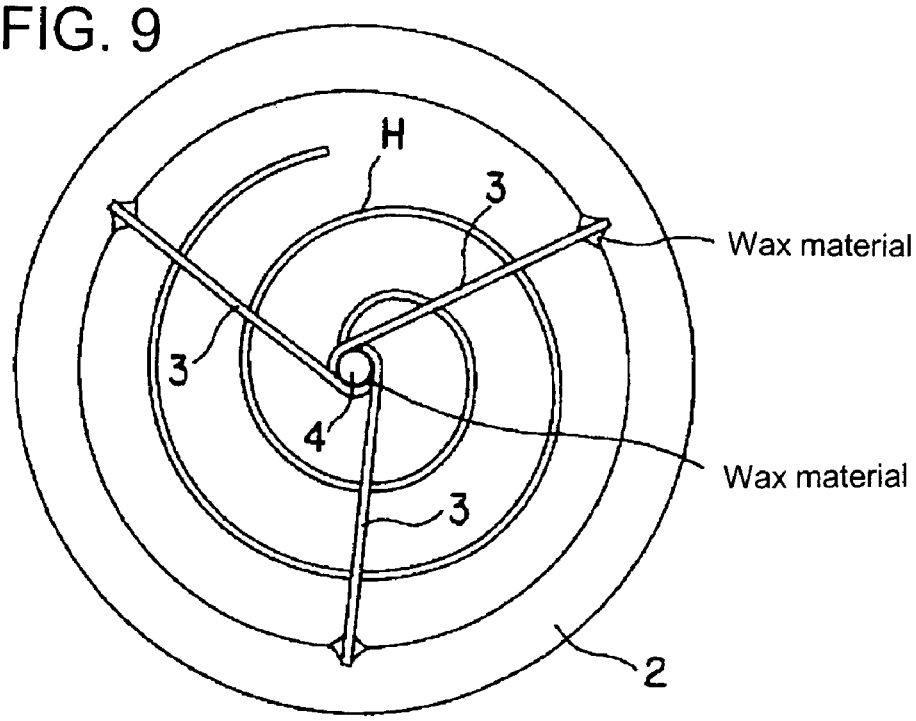
FIG. 9 shows a short arc lamp of still another embodiment, wherein only an electric supply ring, a support member, a cathode, and a heat release member are shown.
Figure 10A:
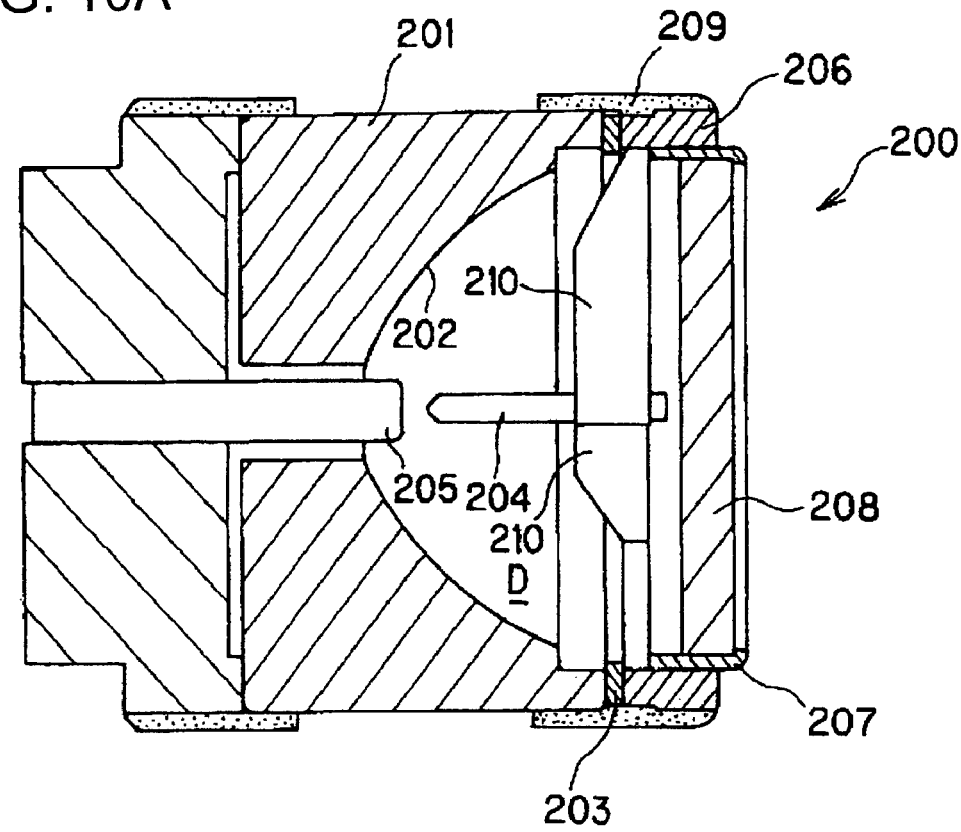
FIGS. 10A and 10B are explanatory diagrams of a conventional short arc lamp.
Figure 10B:
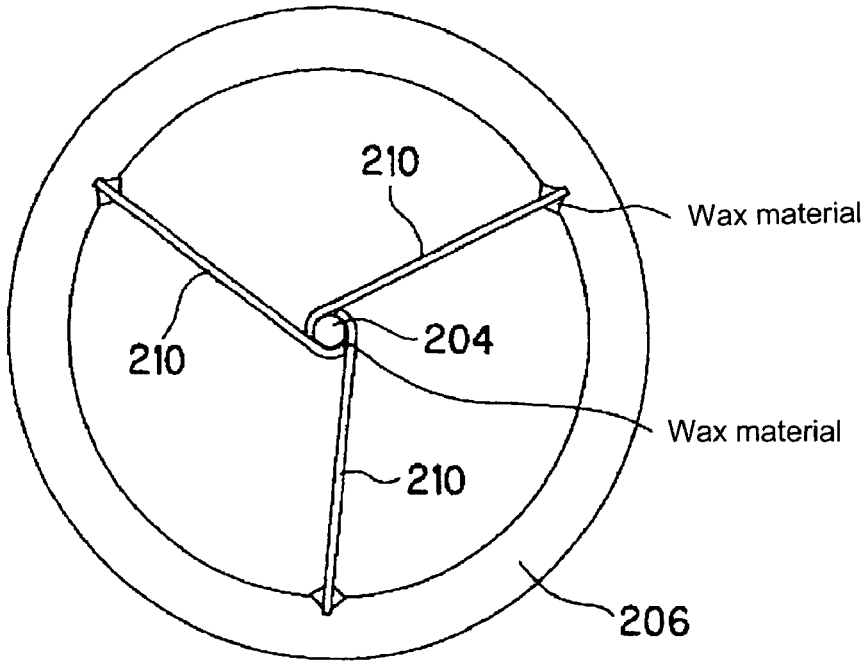

Next, other embodiments of the heat release member(s) connected to the cathode are explained, referring to FIGS. 8 and 9. The structure other than that of the heat release members is the same as that of the short arc lamp shown in FIG. 6. FIGS. 8 and 9 are diagrams showing only an electric supply ring 2, support members 3, a cathode 4, and heat release member(s) H. Each of the heat release member(s) H shown in FIGS. 8 and 9 is a plate-like member made of molybdenum, in which the surface area of the heat release member(s) H is increased, thereby increasing the heat dissipation effect.

In FIG. 8, three of the heat release members H are provided. One end portion of each heat release member H is connected to the cathode 4 by brazing or welding, and the other end portion of each heat release member is a free end. The heat release members are provided at equal intervals. In order to increase the surface area of each heat release member H, each heat release member H is crooked in two or more places, thereby increasing the heat dissipation effect thereof.

In FIG. 9, the number of heat release members H is one, one end portion of which is connected to the cathode 4 by brazing or welding. The heat release member is winded spirally in the electrical discharge space, and the other end of the heat release member is a free end. Since the heat release member H is the spiral shape, the surface area thereof is enlarged, thereby increasing the heat dissipation effect.

In the short arc lamp of the structure where the heat release member(s) H are connected to the cathode 4 shown in FIGS. 8 and 9, the heat capacity of the cathode 4 means the sum total of the heat capacity of the cathode 4 and the heat capacity of the heat release member(s) H. In such a case, when the ratio of the sum total of the heat capacity of the support members 3 to the heat capacity of the cathode 4 exceeds 2.8, the rate at which the heat generated in the cathode is transmitted to the support member is large, so that the temperature rise at a coupling area between the cathode and the support member can be certainly suppressed.

The preceding description has been presented only to illustrate and describe exemplary embodiments of the short arc lamp according to the present invention. It is not intended to be exhaustive or to limit the invention to any precise form disclosed. It will be understood by those skilled in the art that various changes may be made and equivalents may be substituted for elements thereof without departing from the scope of the invention. In addition, many modifications may be made to adapt a particular situation or material to the teachings of the invention without departing from the essential scope. Therefore, it is intended that the invention not be limited to the particular embodiment disclosed as the best mode contemplated for carrying out this invention, but that the invention will include all embodiments falling within the scope of the claims. The invention may be practiced otherwise than is specifically explained and illustrated without departing from its spirit or scope.

What is claimed is:

1. A short arc lamp comprising:

a body portion made of an insulating material and having a curved reflective surface, in which a concave discharge space is formed;

a cathode and anode disposed at a focal point of the reflective surface with a gap;

a support member joined to the cathode, the support member being made of nickel or molybdenum;

an electric supply ring connected to the support member, wherein when a heat capacity of the cathode is A and that of the support member is B, a relationship of A and B is B/A>2.8.

2. The short arc lamp according claim 1, wherein the support member is made of nickel.

3. The short arc lamp according to claim 1, wherein the support member is one of a plurality of supporting members, each support member of the plurality of supporting members being joined to the cathode.

4. The short arc lamp according to claim 3, wherein each support member of the plurality of support members is provided at equal intervals around the cathode.

5. The short arc lamp according to claim 3, wherein the support member is provided in parallel to a lamp axis.

6. The short arc lamp according to claim 1, wherein the support member has first and second sides in a lamp axis direction, the first side is longer than the second side, and the first side is joined to the cathode.

7. The short arc lamp according to claim 1, wherein a heat release member is connected to the support member.

8. The short arc lamp according to claim 7, wherein the heat release member is a plate-like member.

9. The short arc lamp according to claim 7, wherein the heat release member is one of a plurality of heat release members, each heat release member of the plurality of heat release members being joined to the support member.

10. The short arc lamp according to claim 7, wherein the heat release member is made of molybdenum.

11. The short arc lamp according to claim 7, wherein the heat release member is a circular member.

12. The short arc lamp according to claim 1, wherein a heat release member is connected to the cathode.

13. The short arc lamp according to claim 12, wherein the heat release member is one of a plurality of heat release members, the plurality of heat release members being joined to the cathode.

14. The short arc lamp according to claim 13, wherein each heat release member of the plurality of heat release members is provided at equal intervals around the cathode.

15. The short arc lamp according to claim 14, wherein the heat release member is provided in parallel to a lamp axis.

16. The short arc lamp according to claim 12, wherein the heat release member is crooked.

17. The short arc lamp according to claim 12, wherein the heat release member is provided so as to be wound spirally.

18. The short arc lamp according claim 1, wherein the support member is made of molybdenum.

19. The short arc lamp according claim 1, wherein the cathode is made of tungsten.

20. The short arc lamp according claim 1, wherein a total volume of the supporting member is greater than a volume of the cathode.

* * * * *